US005740939A

United States Patent [19]

Muldner et al.

[11] Patent Number: 5,740,939

[45] Date of Patent: Apr. 21, 1998

[54] LINER RETAINER

[76] Inventors: J. Scott Muldner, 18481 Wildflower Dr., Penn Valley, Calif. 95946; Dean Brennan, 21887 Wilson Ct., Cupertino, Calif. 95014

[21] Appl. No.: 650,287

[22] Filed: May 20, 1996

Related U.S. Application Data

[62] Division of Ser. No. 310,138, Sep. 21, 1994, Pat. No. 5,518,136.

[51] Int. Cl.[6] ..... B65F 1/06

[52] U.S. Cl. ..... 220/404; 220/908; 248/101

[58] Field of Search ..... 248/101; 220/404, 220/908

[56] References Cited

U.S. PATENT DOCUMENTS

| | | | |
|---|---|---|---|
| 2,140,199 | 12/1938 | Constantine | 248/101 |
| 4,124,185 | 11/1978 | Preisinger | 248/101 |
| 4,338,979 | 7/1982 | Dow | 220/404 |
| 4,630,752 | 12/1986 | De Mars | 220/404 |
| 5,261,553 | 11/1993 | Mueller et al. | 220/908 |
| 5,295,606 | 3/1994 | Karwoski | 220/404 |
| 5,425,468 | 6/1995 | Birkel et al. | 220/908 |
| 5,501,358 | 3/1996 | Hobday | 220/404 |

FOREIGN PATENT DOCUMENTS

| | | | |
|---|---|---|---|
| 1419805 | 10/1965 | France | 220/404 |

*Primary Examiner*—Stephen J. Castellano
*Attorney, Agent, or Firm*—Carol D. Titus; James J. Leary

[57] ABSTRACT

Disclosed herein is a liner retainer for holding a thin film liner in a container having a mouth. The liner retainer includes a retainer member, a connector member and an anchor member. The retainer member is elastic and formed in the shape of a loop. The retainer member can stretch to circumscribe the container and hold the thin film liner with the container. The extension member attaches to the retainer member and holds the retainer member when the retainer member circumscribes the container. The anchor member attaches to the extension member and is attachable to the container. The anchor member is adjustably positionable with the container for selectively adjusting tension in the connector member.

8 Claims, 6 Drawing Sheets

LINER RETAINER

RELATIONSHIP TO OTHER APPLICATIONS

This application is a divisional application of application Ser. No. 08/310,138 filed Sep. 21, 1994, now U.S. Pat. No. 5,518,136.

BACKGROUND OF THE INVENTION

1. Field of the Invention

This invention relates to liner retainers for holding a liner in a container. More particularly, this invention relates to such liner retainers which rely upon the elasticity of the retainer to hold the liner in the container.

2. Previous Art

Garbage containers have been lined with plastic liners such as thin film plastic garbage bags for many years. The liners protect the interior of the container, ensure removal of all the contents (e.g. waste), and keep the interior of the container relatively clean and odor-free. Liner retainers hold the liners in the container such as while the container is being filled with waste or being emptied.

Typical liners have a top having an open end and a bottom. The liner inserts into the garbage container. The top of the liner opens and folds over the mouth of the garbage container. The bottom of the liner hangs within the garbage container. The container receives waste or other materials which enter the open top of the liner.

When the liner is full, the container may be tipped to empty the contents of the container. Alternatively, the liner may be completely removed and thrown out. During removal of the liner, the edges of the open end of the liner are gathered together. The edges are tied or otherwise connected to close the liner. The liner and its contents are lifted from the container and discarded. A new liner replaces the discarded liner.

Liners often have a tendency to detach from the mouth of the container, leaving a space between the mouth of the container and the liner. Garbage and other waste may fall through the space and remain hidden in the bottom of the container. Hidden garbage such as food waste causes foul odors. Such odors contaminate the container. Proper positioning of the liner in the container is desired to prevent garbage from contaminating the container.

Liners are used in trash compactor containers. When garbage is compacted, however, the compactor mechanism urges the garbage and the liner towards the bottom of the container. The force of the compactor mechanism increases the likelihood of liner movement.

The weight of compacted garbage is greater than the weight of the same volume of uncompacted garbage. The liner of a container of compacted garbage must be firmly held within the container to hold the heavier, compacted garbage.

Various ways of firmly holding a liner in a container have been developed. One example is an elastic band which stretches over the mouth of the container. The elastic band holds the liner against the mouth of the container. When the container is filled or emptied, however, the elastic band tends to roll and slide. Such movement can cause the elastic band to break free of the container and the liner to fall to the bottom of the container.

The elastic band retainer is removed from the container to facilitate removal of the liner. Often, however, the band retainer is discarded with the liner. This occurs because the when the edges of the liner are gripped and pulled upwards from the container, the elastic band rolls up and falls into the liner. When the liner is closed for disposal, the elastic band is lost.

What is desired in the art is a linear retainer which firmly holds a liner in a container. What is additionally desired is a liner retainer that is not easily thrown out when the liner or waste is removed from the container. What is additionally desired is a liner retainer which does not normally roll, slide or allow the liner to fall into the container.

SUMMARY OF AND OBJECTS THE INVENTION

Various objects of the present invention are provided for the purposes of facilitating a better understanding of the present invention. The various objects presented and those which will be apparent are not to be understood in any way which limits the scope of the appended claims.

It is an object of the present invention to provide a retainer which holds a liner such as a garbage bag in a container such as a garbage container.

It is another object of the invention to provide a liner retainer which relies on a retainer member and a connector member for holding a liner in a container.

It is another object of the invention to provide a liner retainer having a connection member which has an adjustable length to adjustably hold a retainer member with a container.

It is another object of the invention to provide a liner retainer having an anchor member which is adjustably positionable to hold the retainer member with a container.

In accordance with the above objects and those that will be mentioned and will become apparent below, a liner retainer is provided which is attachable to a container having a mouth and a replaceable liner, the liner retainer comprising:

a retainer member having an elastic portion defining a loop, the retainer member having a connector member, and the connector member being attachable to the container, whereby the retainer member is positionable around the container and the liner, the liner having its mouth folded over the mouth of the container and the connector member being attachable to the container for holding the liner in place in the container.

In a preferred embodiment, the connector member has an anchor member. The anchor member selectively connects to the container to hold the retainer member with the container. The connector member adjusts in length to apply an adjustable amount of tension to the retainer member.

In a preferred embodiment, the connector member is elastic and the liner retainer is fabricated from a flat strip of elastic material while the anchor member is formed in the shape of a loop. The flat strip of the liner retainer has a first side and a second side, the first side of the liner retainer bonds to the second side of the liner retainer to form the retainer member and the anchor member.

Several preferred embodiments of the present invention use first and second co-acting sections as an attachment means to affix the liner retainer. Optionally, the attachment means may be an adjustable attachment means which allows the user to adjust the amount of tension on the liner retainer as well as adjust the height at which the retainer member is held and otherwise adjust the liner retainer. For example, in a preferred embodiment of the present invention, the anchor member includes at least one Velcro® patch. The Velcro® patch of the anchor member is attachable to a Velcro® strip affixed on the container.

In a preferred embodiment the connector member is an adjustable cord. The anchor member includes at least one knob attached to the adjustable cord. Each knob is selectively attachable to the container to selectively regulate tension in the adjustable cord.

In another preferred embodiment of the invention, the anchor member has a magnet. The magnet being magnetically attachable to the container.

In another preferred embodiment of the invention, the anchor member has a suction cup. The suction cup is attachable with the container via a vacuum seal.

An advantage of the liner retainer of the present invention is that an adjustable amount of force can be selectively applied to a liner to hold the liner in a container. Another advantage is that the liner retainer will not fall from a container when the container is tipped or dumped. An advantage is to provide a liner retainer which attaches to a variety of differently shaped containers.

BRIEF DESCRIPTION OF THE DRAWINGS

For a further understanding of the objects and advantages of the present invention, reference should be given to the following detailed description, taken in conjunction with the accompanying drawing, in which like parts are given like reference numerals and wherein.

DETAILED DESCRIPTION OF THE INVENTION

Figure 1:
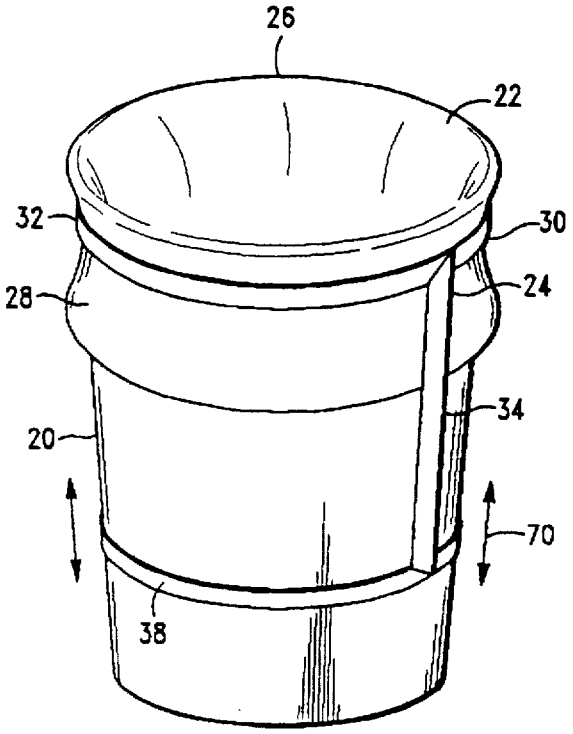
FIG. 1 is a perspective view of a container, a liner and an embodiment of a liner retainer.

FIG. 1 shows a container 20, a liner 22 and a liner retainer 24. The container 20 includes a mouth 26 and a side 36. The liner 22 hangs within the container 20. The liner 22 has a mouth 29 and a folded portion 28 which folds over the mouth 26 of the container 20. The liner retainer 24 secures the mouth 29 of the liner 22 over the mouth 26 of the container 20.

The liner retainer 24 has a connector member 34 and a retainer member 30. The retainer member 30 has a portion defined in the shape of a loop 32. The loop 32 of the retainer member 30 is elastic and conforms to the shape of the container 20. The loop 32 circumscribes the container 20 over the folded portion 28 of the liner 22.

The connector member 34 is attachable to the container 20. The connector member 34 has an anchor member 38. The connector member 34 connects the retainer member 30 to the container 20 via the anchor member 38. The anchor member 38 attaches with the connector member 34 and with the side 36 of the container 20.

The anchor member 38 connects to various selected positions on the container 20. The connector member 34 is flexible and adjusts in length to accommodate varied positioning of the anchor member 38 and to apply an appropriate amount of tension to the retainer member 30. An appropriate amount of tension applied to the retainer member 30 by the connector member 34 holds the liner 22 with the container 20. It can be appreciated that tension applied by the connector member 34 to the retainer member 30 adjusts when the anchor member 38 moves in a direction shown by the arrows 70.

Figure 2:
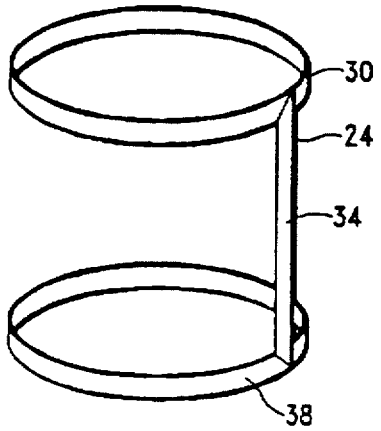
FIG. 2 is a perspective view of the liner retainer of FIG. 1.

FIG. 2 shows the liner retainer 24 of FIG. 1. The connector member 34, the retainer member 30 and the anchor member 38 are fabricated from a single flat strip 48 of elastic material. Accordingly, the connector member 34 adjusts in length in response to tension applied between the retainer member 30 and the anchor member 38.

The anchor member 38 is formed in the shape of a loop 32. The loop 32 is adaptable for stretching to circumscribing the container 20 (see FIG. 1). The loop 32 of the anchor member is the same shape and size as the loop 32 of the retainer member 30 to permit the anchor member 28 and the retainer member 30 to be reversed.

Figure 3:
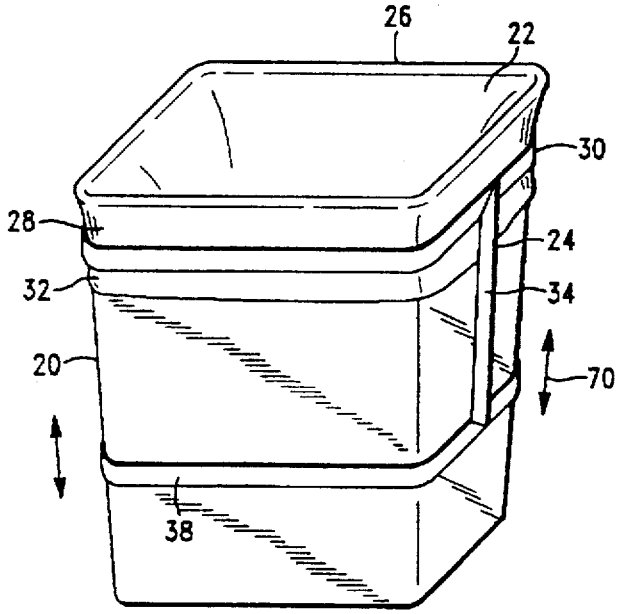
FIG. 3 is a perspective view of a container, a liner and an embodiment of a liner retainer shown in FIG. 1 used around a different type of container.

FIG. 3 shows a liner 22, a container 20, and the liner retainer 24 of FIG. 1. The container 20 has a rectangular cross-section. The anchor member 38 and the retainer member 30 stretch to conform to the rectangular shape of the container 20.

Figure 4:
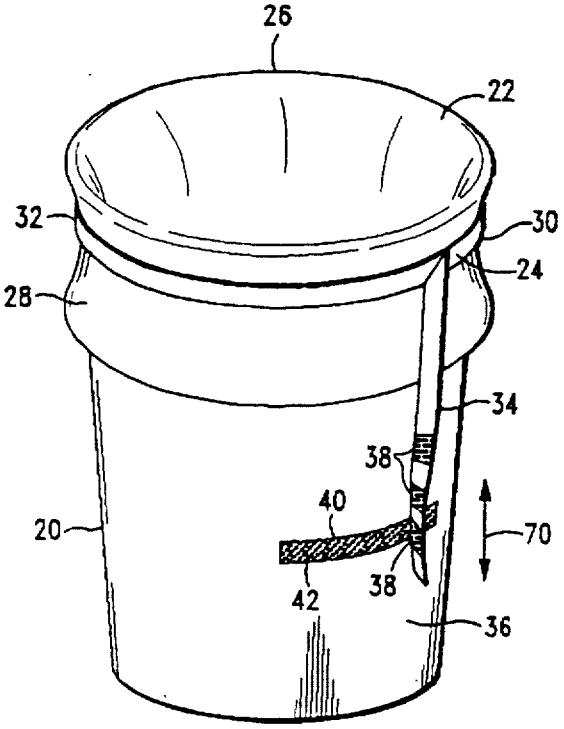
FIG. 4 is a perspective view of a container, a liner and another embodiment of a liner retainer.

FIG. 4 shows an embodiment of the liner retainer 24, the liner 22 and a container 20. The side 36 of the container 20 includes an attachment point 40. The attachment point 40 includes a Velcro® strip 42 (Velcro® is a trade name representing a removeably interlocking fabric).

The anchor member 38 includes at least one Velcro® patch 44. The two Velcro® segments, the Velcro® strip 42 of the attachment point 40 and the Velcro® patch 44 of the anchor member 38, form an attachment means. Each Velcro® patch 44 of the anchor member 38 is square shaped. Each Velcro® patch 44 is sized to interconnect with the Velcro® strip 42 of the container 20. Each Velcro® patch 44 is selectively attachable with the Velcro® strip 42 of the container 20. The connector member 34 adjusts in length along the direction of arrow 70 by selective attachment of each Velcro® patch 44 to the container 20, thereby providing an adjustable attachment means.

Figure 5:
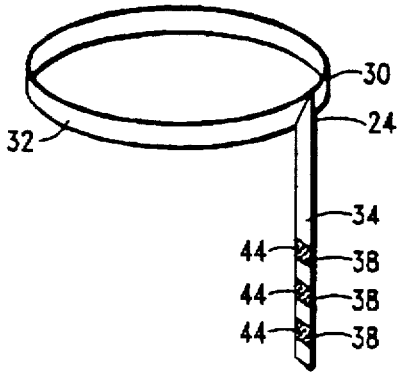
FIG. 5 is a perspective view of the liner retainer of FIG. 4.

FIG. 5 shows the liner retainer 24 of FIG. 4. The connector member 34 includes a first end and a second end. The first end of the connector member attaches with the retainer member 30. The Velcro® patches 44 are aligned and equally spaced in positions adjacent the first end of the connector member 34. The retainer member 30 attaches to the second end of the connector member 34.

Although square patches are shown attached on the connector member 34, and the container 20 includes a single Velcro® strip 42, it can be appreciated that alternate configurations will work to permit selective adjustment of the connector member. For example, the connector member 34 can have a single Velcro® patch 44 and the container 20 can have a plurality of Velcro® strips 42.

Figure 6:
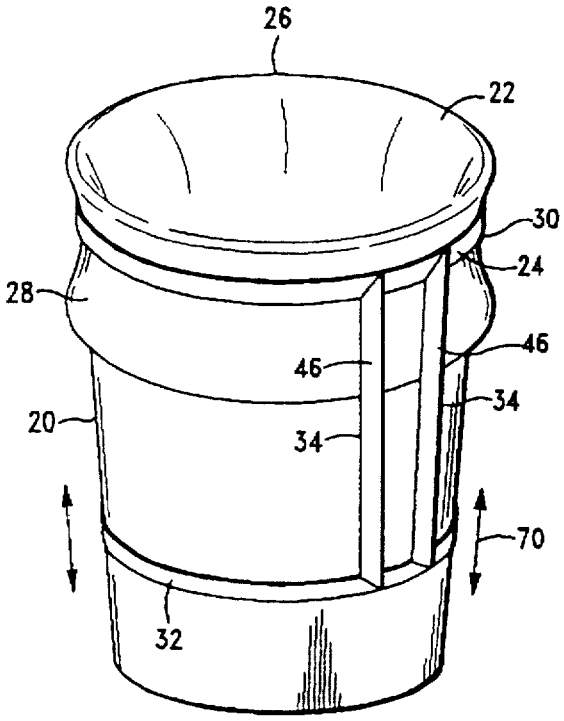
FIG. 6 is a perspective view of a container, a liner and another embodiment of a liner retainer.
Figure 7:
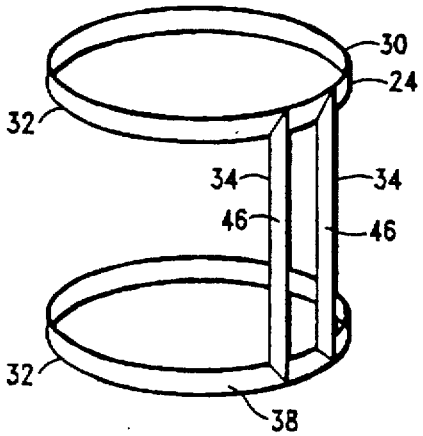
FIG. 7 is a perspective view of the liner retainer of FIG. 6.

FIGS. 6–7 show an embodiment of the liner retainer 24 where the connection member includes two strips 46 of elastic material. The strips 46 are parallel with each other. In FIG. 6 the liner retainer 24 attaches with a liner 22 and a container 20. In FIG. 7, the container 20 is not shown. Each strip 46 attaches between the retainer member 30 and the anchor member 38. The elastic strips 46 are configured integral with the retainer member 30 and the anchor member 38 for holding the retainer member 30 and the anchor member 38 together.

Although elastic strips 46 are shown parallel with each other, the elastic strips 46 may be aligned in alternate configurations. For example, the elastic strips may be angled for when an angled configuration of the elastic strips 46 enables the elastic strips 46 to be adaptable for conforming to the shape of the container 20.

Figure 8:
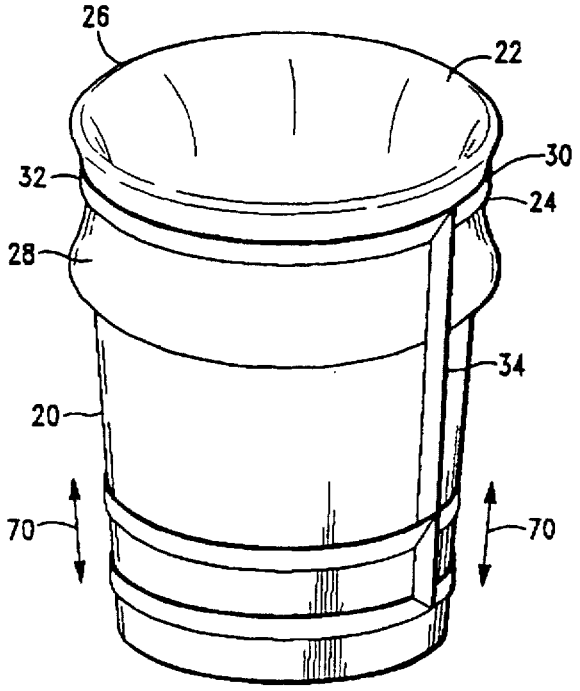
FIG. 8 is a perspective view of a container, a liner and another embodiment of a liner retainer.
Figure 9:
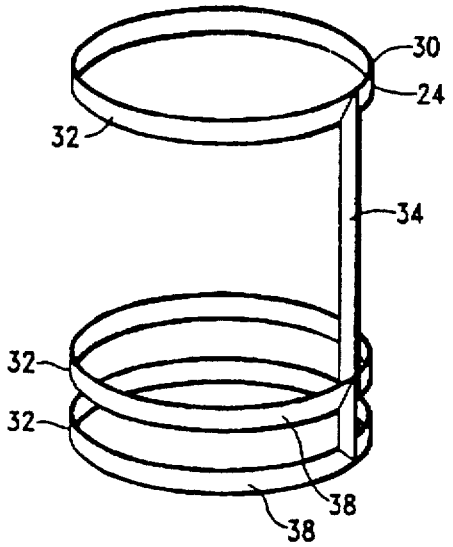
FIG. 9 is a perspective view of the liner retainer of FIG. 8.

FIGS. 8–9 show an embodiment of the liner retainer 24 where the anchor member 38 is a pair of elastic loops 32. Each loop 32 is attached to the connector member 34 and is adaptable to circumscribe the container 20. The loops 32 are the same size as each other and lie in parallel plains when attached with the container 20. It can be appreciated, however, that the loops 32 of the anchor member 38 can be of different sizes, or lie in diagonal plains to conform to in shapes of various other containers.

Figure 10:
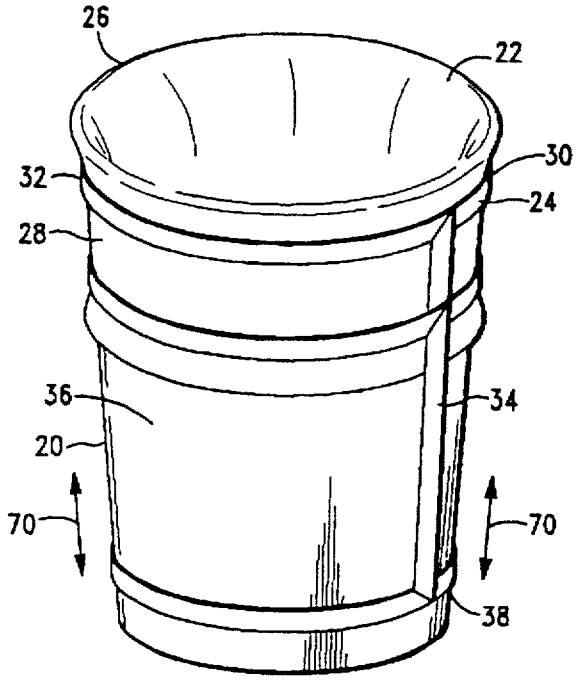
FIG. 10 is a perspective view of a container, a liner and another embodiment of a liner retainer.
Figure 11:
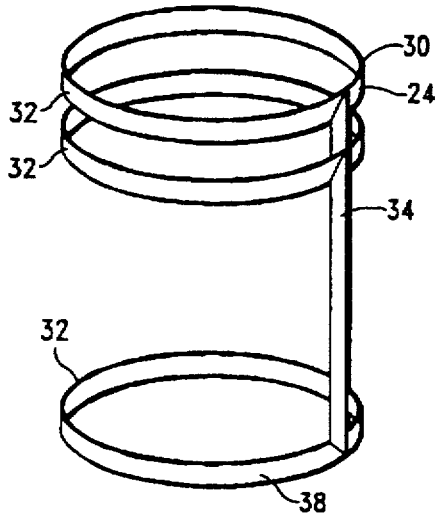
FIG. 11 is a perspective view of the liner retainer of FIG. 10.

FIGS. 10–11 show an embodiment of the liner retainer 24 where the retainer member 30 includes a pair of loops 32. Each loop 32 is adaptable for circumscribing the container 20 and holding the folded portion 28 of the liner 22 about the mouth 26 of the container 20. In FIG. 10, the pair of loops 32 hold the liner retainer 24 about the mouth 26 of the container 20. FIG. 11 shows the liner retainer of FIG. 10.

Figure 12:
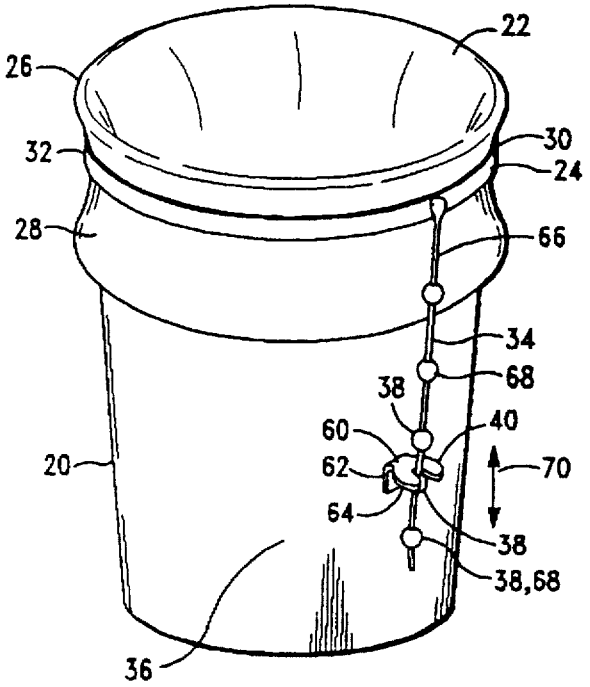
FIG. 12 is a perspective view of a container, a liner and another embodiment of a liner retainer.
Figure 13:
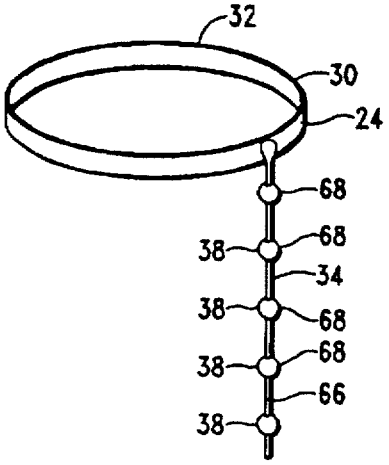
FIG. 13 is a perspective view of the liner retainer of FIG. 12.

FIGS. 12–13 show an embodiment of the liner retainer 24 where the connector member 34 is an adjustable cord 66. The anchor member 38 includes several knobs 68 serially attached along to the adjustable cord 66. In FIG. 12, the knob attachment point 60 of the container includes an elbow 62 and a hook 64. Each knob 68 is attachable with the hook 64 on the container 20 (see FIG. 12). Selective attachment of the knobs 68 to the knob attachment point 60 regulates tension in the adjustable chord 66 for holding the liner 22 in the container 20.

It can be appreciated that when a knob 68 attaches with the hook 64 of the knob attachment point 60 as shown, that the adjustable chord 66 may be pulled in the direction shown by the arrow 70. Each knob 68 may be fabricated from elastic material to improve the connection between the hook 64 of the knob attachment point 60 on the container 20 and each knob 68.

Figure 14:
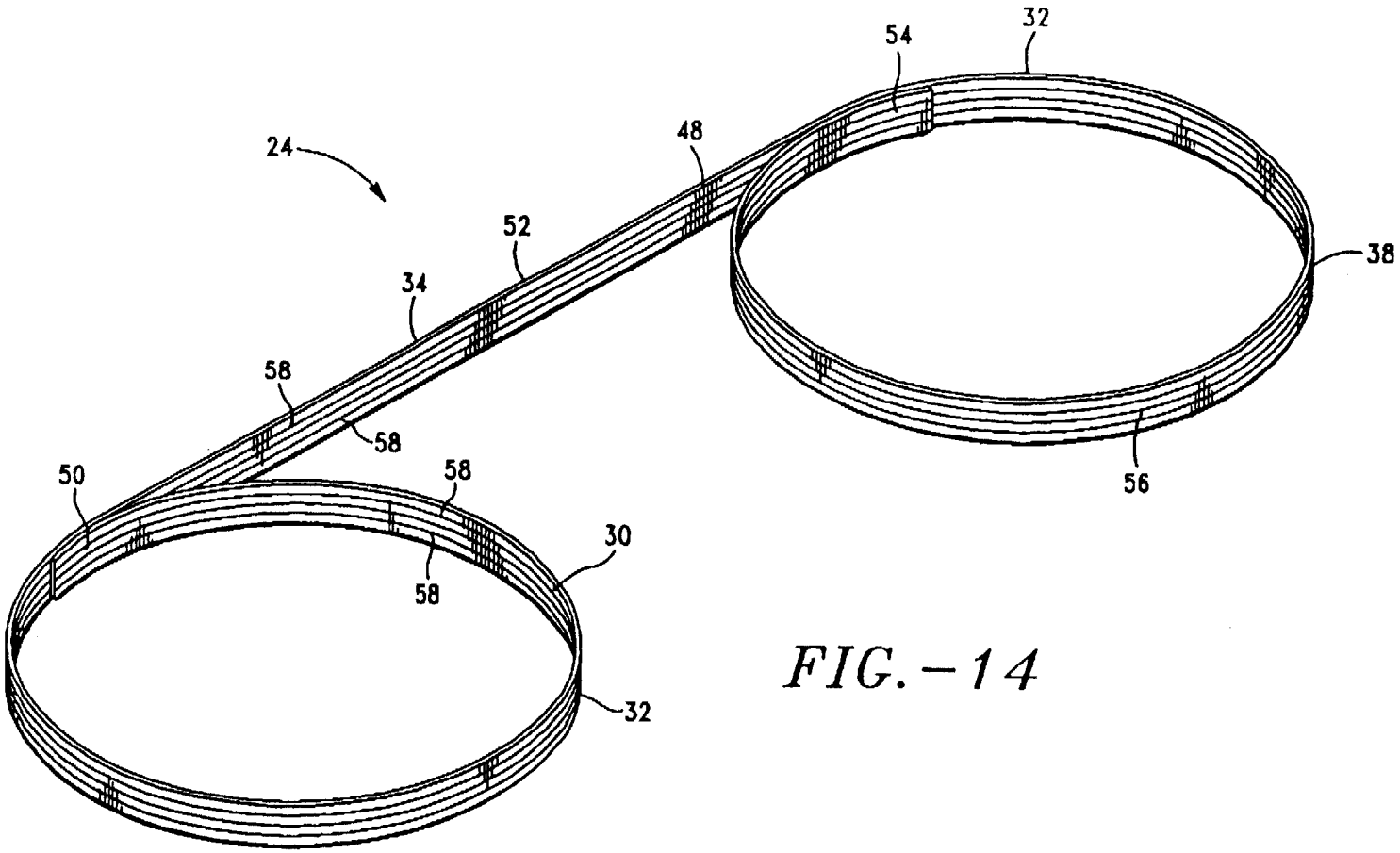
FIG. 14 is a perspective view of the liner retainer of FIG. 1.

FIG. 14 shows a view of the liner retainer 24 of FIG. 1. The liner retainer 24 is fabricated from a single flat strip 48 of elastic material. The flat strip 48 of elastic material includes a first end 50, a length 52 and a second end 54. The first end 50 of the flat strip 48 bonds with the length 52 of the flat strip 48 to form the loop 32 of the retainer member 30. The second end 54 of the flat strip 48 bonds with the length 52 to form the loop 32 of the anchor member 38. A portion of the length 52 extends between the retainer member 30 and the anchor member 38. This portion of the length 52 defines the connector member 34.

The flat strip 48 has an inside and an outside. The outside of the flat strip 48 at the first end 50 bonds with the inside of the length 52 of the flat strip 48 to form the loop 32 of the retainer member 30. The outside of the flat strip 48 at the second end 54 bonds with the inside of the length 52 of the flat strip 48 to define the loop 32 of the anchor member 38.

The inside and the outside of the flat strip 48 have a texture 56. The texture 56 includes rows of parallel ridges 58 extending axially along the flat strip 48. The texture 56 on the inside of the retainer member 30 enables the retainer member 30 to grip the liner 22. The texture 56 on the inside of the anchor member 38 enables the anchor member 38 to grip the container 20. The texture 56 is provided on the outside of the flat strip 48 to enable the liner retainer 24 to hold the liner 22 and the container 20 when the flat strip 48 twists and the outside of the flat strip 48 contacts the liner 22 and the container 20 respectively.

Figure 15:
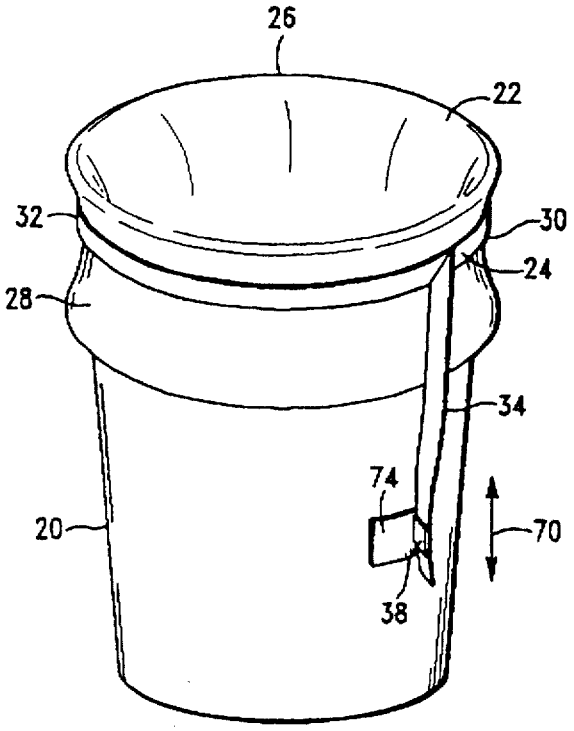
FIG. 15 is a perspective view of a container, a liner and another embodiment of a liner retainer.

FIG. 15 shows an embodiment of the liner retainer 24 where the anchor member 38 includes a magnet 74. The magnet is attachable to the side 36 of the container 20. The positioning of the magnet on the container 20 is adjustable as shown by the arrow 70. Selective positioning of the magnet 74 applies tension to the connector member 34.

Figure 16:
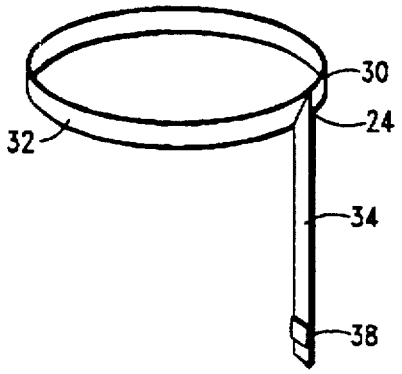
FIG. 16 is a perspective view of the liner retainer of FIG. 15.

FIG. 16 shows the liner retainer 24 of FIG. 15. The anchor member 38 is positioned adjacent an end of the connector member 34. Although a container having a magnet is disclosed in FIGS. 15–16, variations of the concept of a magnetic attachment between the liner retainer 24 and the container are possible. For example, the anchor member 38 may be fabricated from a magnetically responsive material (e.g. an iron patch) and the container 20 may include a magnet.

Figure 17:
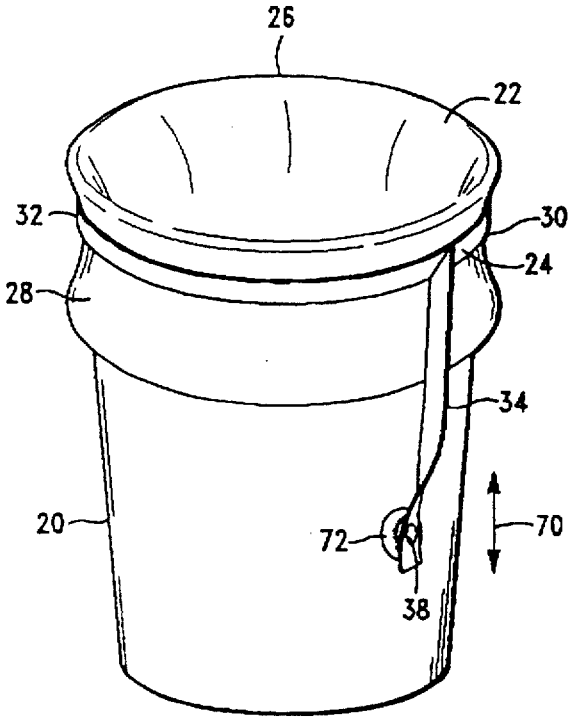
FIG. 17 is a perspective view of a container, a liner, and another embodiment of a liner retainer.

FIGS. 17 shows a liner retainer 24 attached with a container 20 having a liner 22. The side 36 of the container 20 is smooth. The anchor member 38 includes a suction cup 72 which is attachable with the smooth side 36 of the container. The suction cup 72 attaches to the connector member 34 in a position adjacent the end of the connector member 34. The suction cup 72 selectively positionable on the side 36 of the container 20 as indicated by the arrow 70. Selective positioning of the suction cup 72 adjusts the length of and tension in the connection member 34 as desired. The connection member 34 is twisted. Twisting the connection member 34 also adjusts the length of and the tension in the connection member 34.

Figure 18:
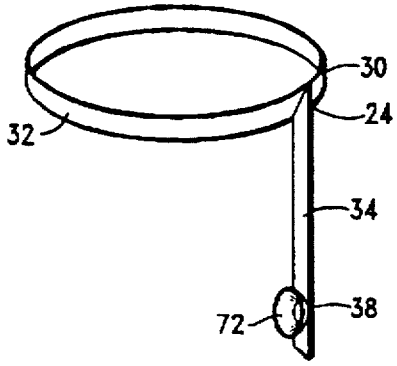
FIG. 18 is a perspective view of the liner retainer of FIG. 17.

FIG. 18 shows the liner retainer 24 having the suction cup 72 attached to the end of the connector member 34. The other end of the connector member 34 attaches to the retainer member 32. The suction cup 72 is attachable with smooth surfaces such as the side 36 of the container 34.

While the foregoing description has described preferred embodiments of the liner retainer 24 for holding a liner 22 in a container 20 in accordance with the present invention, it is to be understood that the above description is illustrative only and should not limit the scope of the present invention. For example, the liner retainer may be adapted for use with different kinds of containers in addition to the disclosed use with a garbage container. The liner retainer 24 may be adapted for use with containers of various sizes and shapes. The liner retainer 24 may be fabricated from a suitable material to resist corrosion and enable use of the liner retainer in a caustic environment. Accordingly, the invention and multiple uses thereof are to be limited solely by the claims set forth below.

What is claimed is:

1. A liner retainer being attachable to a container having a mouth and a replaceable liner, the liner retainer comprising:

a retainer member having an elastic portion defining a loop a connector member being attachable to an exterior surface of the container, wherein the retainer member is positionable around the container and the liner, the liner having its mouth folded over the mouth of the container and the connector member being attachable to the container for holding the liner in place in the container, an anchor member depending from the connector member and being connectable to the container, and wherein the anchor member includes at least one hook and loop fastener, each hook and loop fastener of the anchor member being attachable with the container.

2. A liner retainer attachable with a container having a mouth and a thin film liner having a mouth, the liner retainer comprising:

a retainer member, wherein the retainer member is elastic and formed in the shape of a loop;

an anchor member, wherein the anchor member is attachable with the container;

a connector member, the connector member attaches with the retainer member and with the anchor member to hold the retainer member, the connector member being adjustable in length, and an attachment means for attaching the anchor member to the container wherein the attachment means is formed of a first co-acting section and a second co-acting section, the first co-acting section forming at least a part of the anchor member and the second co-acting section being attached to the container, wherein at least one of the first co-acting section and the second co-acting section is chosen from the group of members consisting of hook fasteners, and loop fasteners, whereby when the mouth of the thin film liner folds over the mouth of the container, the retainer member is flexible enough to encircle the container and hold the thin film liner.

3. The liner retainer of claim 2 wherein the connector member is adjustable in length to apply an adjustable amount of tension on the retainer member.

4. A liner retainer attachable with a container having a mouth and a thin film liner having a mouth, the liner retainer comprising:

a retainer member, wherein the retainer member is elastic and formed in the shape of a loop;

an anchor member, wherein the anchor member is attachable with the container; and a connector member, the connector member attaches with the retainer member and with the anchor member to hold the retainer member, the connector member being adjustable in length, whereby when the mouth of the thin film liner folds over the mouth of the container, the retainer member is flexible enough to encircle the container and hold the thin film liner, and wherein the anchor member attaches to an attachment point which is permanently attached to the container.

5. A retainer system comprising:

a retaining means for retaining a mouth of a liner around a mouth of a container, and an adjustable anchor means for adjustably anchoring the retaining means to an exterior surface of the container, wherein the adjustable anchor means has a connector member which detachably attaches the retaining means to an attachment point, the attachment point being attached to the container.

6. The retainer system of claim 5 wherein the adjustable anchor means further comprises an anchor member, the connector member being attached to the retaining means and the anchor member being attached to the connector member, the anchor member being attachable to the container.

7. The retainer system of claim 6 wherein the anchor member is a first co-acting section and the adjustable anchor means further comprises a second co-acting section, the second co-acting section being attached to the container, said first and second co-acting sections are mutually attachable.

8. The retainer system of claim 5 wherein the connector member has a first co-acting section and the attachment point is a second co-acting section, wherein the first and second co-acting sections are mutually attachable.

* * * * *